US010418192B1

(12) United States Patent
Yang

(10) Patent No.: US 10,418,192 B1
(45) Date of Patent: Sep. 17, 2019

(54) VACUUM INTERRUPTER FOR USE IN A LOW VOLTAGE, LOW CURRENT RESIDENTIAL CIRCUIT BREAKER

(71) Applicant: Guang Yang, Suwanee, GA (US)

(72) Inventor: Guang Yang, Suwanee, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 16/111,769

(22) Filed: Aug. 24, 2018

Related U.S. Application Data

(60) Provisional application No. 62/661,462, filed on Apr. 23, 2018.

(51) Int. Cl.

| | |
|---|---|
| ***H01H 1/22*** | (2006.01) |
| ***H01H 1/58*** | (2006.01) |
| ***H01H 9/04*** | (2006.01) |
| ***H01H 9/48*** | (2006.01) |

(52) U.S. Cl.
CPC ..... *H01H 1/22* (2013.01); *H01H 1/58* (2013.01); *H01H 9/041* (2013.01); *H01H 9/48* (2013.01)

(58) Field of Classification Search
CPC .. H01H 1/22; H01H 1/58; H01H 1/64; H01H 1/66; H01H 9/041; H01H 9/48; H01H 33/6664; H01H 2033/6665; H01H 71/02; H01H 71/08
USPC ..... 218/100, 10, 11, 42, 118, 121, 88, 140
See application file for complete search history.

(56) References Cited

U.S. PATENT DOCUMENTS

| | | | | |
|---|---|---|---|---|
| 2,129,892 A * | 9/1938 | Vatter | H01H 33/6664 | 218/118 |
| 2,892,052 A * | 6/1959 | Ducati | H01H 51/287 | 218/123 |
| 3,689,722 A * | 9/1972 | Ratliff | C03C 27/046 | 200/263 |
| 3,727,018 A * | 4/1973 | Wesoloski | H01H 33/66207 | 218/124 |
| 3,818,392 A * | 6/1974 | Guichard | H01H 51/287 | 218/123 |
| 4,031,494 A * | 6/1977 | Archer | H01H 1/66 | 200/283 |
| 4,363,011 A * | 12/1982 | Turczanski | H01H 11/005 | 335/151 |
| 5,597,992 A * | 1/1997 | Walker | H01H 33/6606 | 218/121 |
| 8,779,317 B2 * | 7/2014 | Kim | H01H 33/664 | 218/118 |
| 9,287,065 B1 * | 3/2016 | Davis | H01H 9/52 | |

* cited by examiner

*Primary Examiner* — Edwin A. Leon
*Assistant Examiner* — William A Bolton

(57) ABSTRACT

A vacuum interrupter is provided for use in a low voltage residential circuit breaker. The vacuum interrupter comprises a sealed vacuum tube. The sealed vacuum tube is being closed at a first end with an end plate and closed at a second end with an end spring. The vacuum interrupter comprises a first contact terminal passing through the end plate and having a fixed contact near a distal end of the first contact terminal. The vacuum interrupter comprises a second contact terminal having a free end. The second contact terminal passing through the end spring and having a movable contact being configured to contact the fixed contact of the first contact terminal. The end spring is configured to receive a force on the free end of the second contact terminal to provide open or close operations of the vacuum interrupter.

17 Claims, 3 Drawing Sheets

VACUUM INTERRUPTER FOR USE IN A LOW VOLTAGE, LOW CURRENT RESIDENTIAL CIRCUIT BREAKER

CROSS REFERENCE TO RELATED APPLICATIONS

This application claims the benefit of U.S. Provisional Application Ser. No. 62/661,462 entitled "VACUUM INTERRUPTER FOR LOW VOLTAGE LOW CURRENT APPLICATIONS," filed on Apr. 23, 2018, the contents of which are hereby incorporated by reference herein in their entirety.

BACKGROUND

1. Field

Aspects of the present invention generally relate to a vacuum interrupter for use in a low voltage, low current residential circuit breaker deployed for low voltage residential applications, being 240V or less and 60 A or less, having much less arcing to extinguish and having much lower dielectric requirements. The vacuum interrupter comprises a tube and a structure in that by moving a portion of a movable arm outside the tube, a movable contact may be opened or closed onto a fixed contact.

2. Description of the Related Art

Vacuum interrupters are the most dominated interruption devices in medium voltage (~1 kV-38 kV) applications, and have some fundamental advantages that are also attractive to low voltage residential applications (240V or less, 60 A or less). First, there is no open arc due to the sealed vacuum tube, and hence it eliminates the arcing contamination to the rest of the breaker and increases reliabilities. Second, the contact opening can be as small as 0.080 inch even for ~10 kV (comparing to 0.5 inch to 1 inch at 120V in residential circuit breakers), therefore, the operating mechanism can be small. Together, a vacuum interrupter can potentially increase the free space inside a residential circuit breaker. And such increased free space can be used to put more functions into the breakers, such as lockout, AFCI (arc fault circuit interrupter), GFCI (ground fault circuit interrupter) and electronic tripping components.

However, using existing vacuum interrupter designs in low voltage residential applications is not economical. FIG. 1 shows a typical vacuum interrupter 5. At one end, a fixed contact 7(1) is mounted on one end plate 10(1) that is sealed on a ceramic or glass tube 15, and at other end 10(2), a movable contact 7(2) is mounted on a metal bellow 20 to realize the open and close of contacts. Normally arc shields 25(1-2) are provided to protect the tube 15 and the bellow 20. Since this type of the construction is normally used for repetitive medium voltage and high current (a few kilo amperes) interruptions, it normally uses specially designed contact material and robust bellow and is vacuumed in controlled furnace and assembled in clean rooms. All of above end up to be cost prohibitive to being used in low voltage residential applications. Also, some components, such as the bellow and the contacts, are not easily made to meet the high production volume in the residential market. On the other hand, low voltage residential applications, being 240V or less and 60 A or less, have much less arcing to extinguish and have much lower dielectric requirements.

Therefore, there is an instant need for a vacuum interrupter for use in a low voltage residential circuit breaker with a more cost effective vacuum interrupter construction.

SUMMARY

Briefly described, aspects of the present invention relate to a vacuum interrupter for use in a low voltage residential circuit breaker. The vacuum interrupter has a more cost effective construction.

In accordance with one illustrative embodiment of the present invention, a low voltage residential circuit breaker is provided. It comprises a vacuum interrupter including a sealed vacuum tube. The tube has a first end and a second end such that the tube is being closed at the first end with an end plate and closed at the second end with an end spring. The vacuum interrupter further comprises a first contact terminal passing through the end plate and having a fixed contact near a distal end of the first contact terminal. The first contact terminal has a first feature to protect from arcs by limiting access of the arcs to other components. The vacuum interrupter further comprises a second contact terminal having a free end. The second contact terminal passing through the end spring and having a movable contact being configured to contact the fixed contact of the first contact terminal. The second contact terminal having a second feature to protect from the arcs by limiting access of the arcs to the other components. The end spring is configured to receive a force on the free end of the second contact terminal to provide open or close operations of the vacuum interrupter.

In accordance with one illustrative embodiment of the present invention, a vacuum interrupter is provided. The vacuum interrupter comprises a sealed vacuum tube comprising at least one of a group of materials including a glass, a ceramic, and a glass-ceramic. The tube has a first end and a second end such that the tube is being closed at the first end with an end plate and closed at the second end with an end spring. The vacuum interrupter comprises a first contact terminal passing through the end plate and having a fixed contact near a distal end of the first contact terminal. The vacuum interrupter comprises a second contact terminal having a free end. The second contact terminal passing through the end spring and having a movable contact being configured to contact the fixed contact of the first contact terminal. The end spring is configured to receive a force on the free end of the second contact terminal to provide open or close operations of the vacuum interrupter.

DETAILED DESCRIPTION

To facilitate an understanding of embodiments, principles, and features of the present invention, they are explained hereinafter with reference to implementation in illustrative embodiments. In particular, they are described in the context of a vacuum interrupter for use in a low voltage residential circuit breaker. This invention proposes a construction for a vacuum interrupter design that may be used for low voltage low current applications as it is a cost effective solution.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
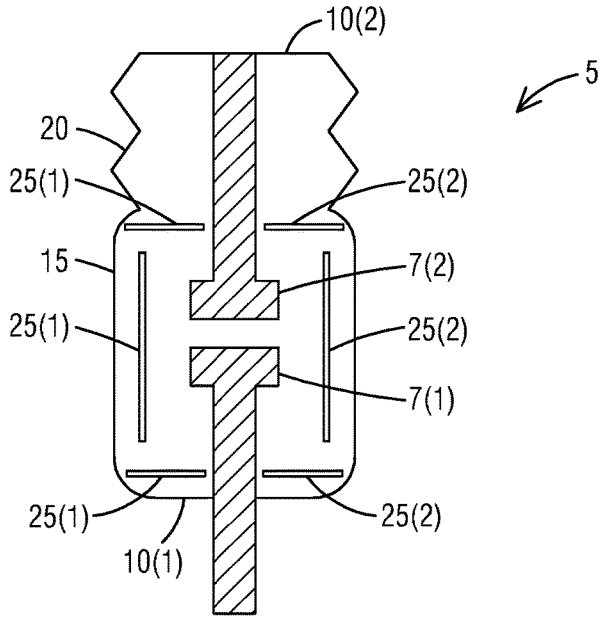
FIG. 1 PRIOR ART
FIG. 1 shows a typical vacuum interrupter.
Figure 2:
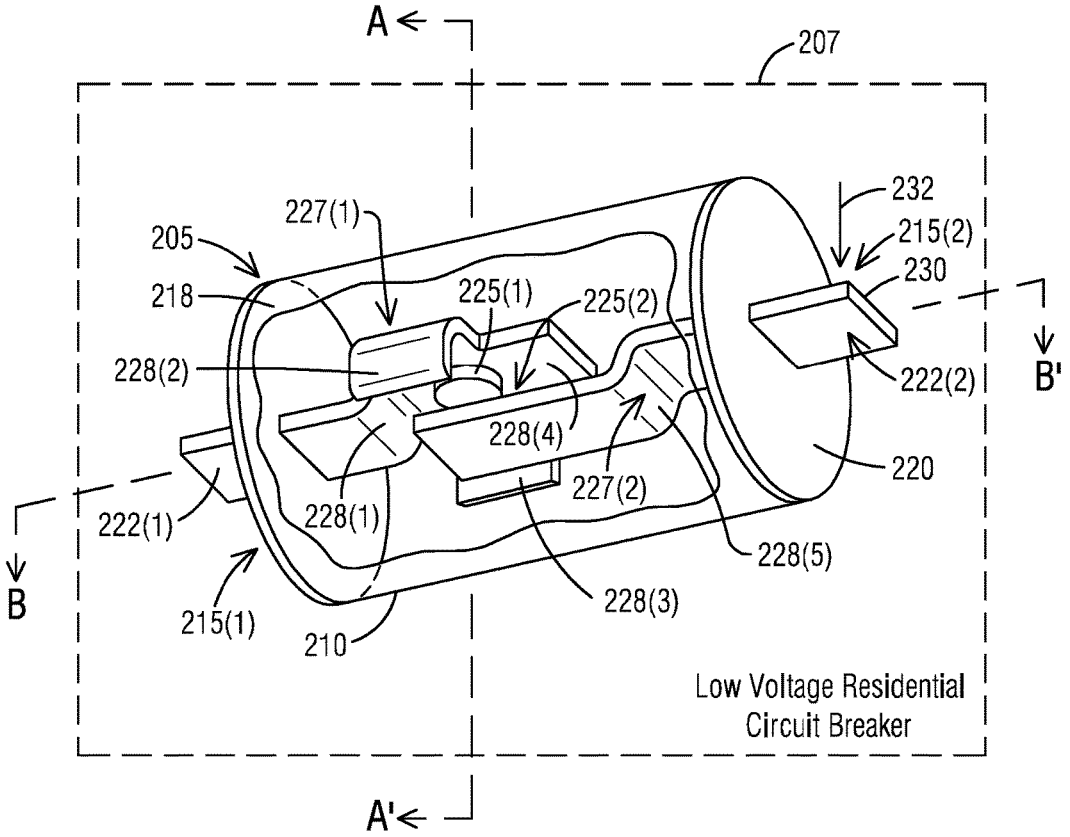
FIG. 2 illustrates a perspective view of a vacuum interrupter for use in a low voltage residential circuit breaker in accordance with an exemplary embodiment of the present invention.

Referring to FIG. 2, it illustrates a perspective view of a vacuum interrupter 205 for use in a low voltage residential circuit breaker 207 in accordance with an exemplary embodiment of the present invention. The low voltage residential circuit breaker 207 comprises the vacuum interrupter 205 including a sealed vacuum tube 210 comprising at least one of a group of materials including a glass, a ceramic, a metal, an alloy and a glass-ceramic. Glass can be called as a type of ceramic. Glass is known to be a non-crystalline material. It is an amorphous solid, which means that it has no long-range order of positioning of its molecules.

Unlike glass, ceramics may have crystalline or partly crystalline structures. A ceramic material is an inorganic, non-metallic, often crystalline oxide, nitride or carbide material. Some elements, such as carbon or silicon, may be considered ceramics. Ceramic materials are brittle, hard, and strong in compression, weak in shearing and tension. The crystallinity of ceramic materials ranges from highly oriented to semi-crystalline, vitrified, and often completely amorphous (e.g., glasses). Most often, fired ceramics are either vitrified or semi-vitrified. Varying crystallinity and electron consumption in the ionic and covalent bonds cause most ceramic materials to be good thermal and electrical insulators. Ceramics generally can withstand very high temperatures, such as temperatures that range from 1,000° C. to 1,600° C. (1,800° F. to 3,000° F.). Glass is often not considered a ceramic because of its amorphous (non-crystalline) character. However, glassmaking involves several steps of the ceramic process and its mechanical properties are similar to ceramic materials. Crystalline ceramic materials are not amenable to a great range of processing. The glass is shaped when either fully molten, by casting, or when in a state of toffee-like viscosity, by methods such as blowing into a mold. If later heat treatments cause this glass to become partly crystalline, the resulting material is known as a glass-ceramic.

Glass-ceramics have an amorphous phase and one or more crystalline phases and are produced by a so-called "controlled crystallization" in contrast to a spontaneous crystallization, which is usually not wanted in glass manufacturing. Glass-ceramic commonly referred to as glass but it is actually a transparent ceramic. Unlike true glass, ceramics can withstand continuous exposure to high temperatures without fear of destruction. It is also resistant to failure due to temperature variation. Glass-ceramic is a little different. Formed in a two step process, glass-ceramic encourages crystalline growth in the second phase of production. In this process the growth of crystals is controlled, allowing uniform growth within the glass. Ordinarily crystal growth isn't a good thing, but with glass-ceramic you get the advantages of glass with the durability of ceramics.

In one embodiment, the sealed vacuum tube 210 has a first end 215(1) and a second end 215(2) such that the sealed vacuum tube 210 is being closed at the first end 215(1) with an end plate 218 and closed at the second end 215(2) with an end spring 220. The vacuum interrupter 205 further comprises a first contact terminal 222(1) passing through the end plate 218 and having a fixed contact 225(1) near a distal end of the first contact terminal 222(1). The first contact terminal 222(1) has a first feature 227(1) to protect from arcs by limiting access of the arcs to other components. The vacuum interrupter 205 further comprises a second contact terminal 222(2) having a free end 230. The second contact terminal 222(2) passing through the end spring 220 and having a movable contact 225(2) being configured to contact the fixed contact 225(1) of the first contact terminal 222(1). The second contact terminal 222(2) has a second feature 227(2) to protect from the arcs by limiting access of the arcs to the other components.

The first feature 227(1) to protect from the arcs includes a first bend 228(1) on the first contact terminal 222(1), first and second wings 228(2-3) on the first contact terminal 222(1), and an extension 228(4) on the first contact terminal 222(1). The second feature 227(2) to protect from the arcs includes a second bend 228(5) on the second contact terminal 222(2) being a movable arm.

The fixed contact 225(1) is mounted on the first contact terminal 222(1) which is in turn mounted on the end plate 218. The fixed contact 225(1) may be welded on the first contact terminal 222(1). The fixed contact may be riveted on the first contact terminal 222(1). The first contact terminal 222(1) may be brazed on the end plate 218 and the end plate 218 is sealed on the sealed vacuum tube 210. The first contact terminal 222(1) may be soldered on the end plate 218 and the end plate 218 is sealed on the sealed vacuum tube 210.

The movable contact 225(2) is mounted on the second contact terminal 222(2) being a movable arm which is mounted on the end spring. The movable contact 225(2) may be welded on the movable arm. The movable contact 225(2) may be riveted on the movable arm. The movable arm may be brazed on the end spring 220 and the end spring 220 is sealed on the sealed vacuum tube 210. The movable arm may be soldered on the end spring 220 and the end spring 220 is sealed on the sealed vacuum tube 210.

The end spring 220 is configured to receive a force 232 on the free end 230 of the second contact terminal 222(2) to provide open or close operations of the vacuum interrupter 5. By moving a portion of the movable arm, the movable contact 225(2) is configured to be opened or closed onto the fixed contact 225(1). The end spring 220 deforms in response to the force 232 The end spring 220 has a material, a thickness and a diameter which are chosen in such a way that the end spring 220 stays in an elastic range during the open or close operations.

Figure 3:
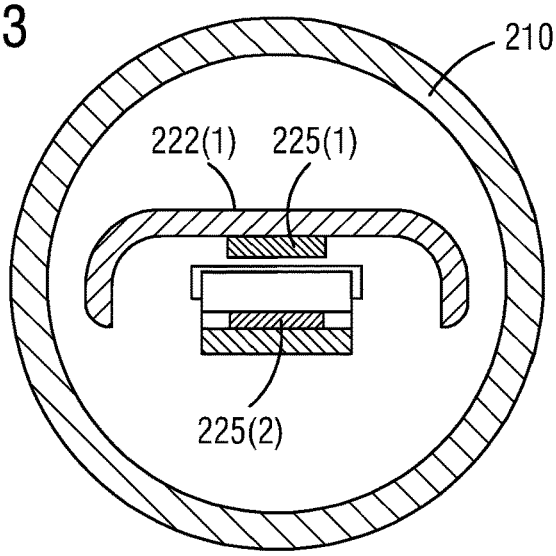
FIG. 3 illustrates a cross-sectional view of the vacuum interrupter of FIG. 2 at a line A-A' in accordance with an exemplary embodiment of the present invention.
Figure 4:
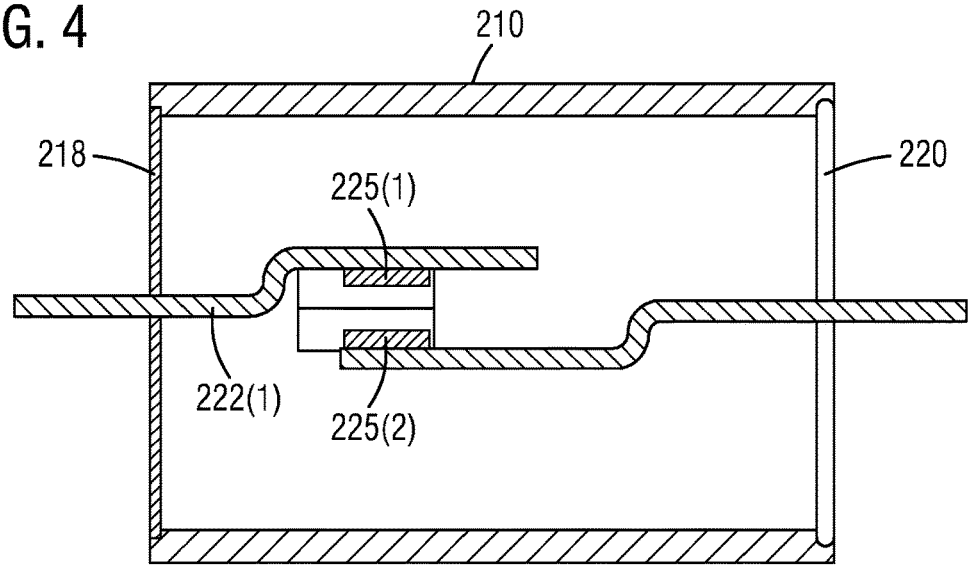
FIG. 4 illustrates a cross-sectional view of the vacuum interrupter of FIG. 2 at a line B-B' in accordance with an exemplary embodiment of the present invention.

Turning now to FIG. 3, it illustrates a cross-sectional view of the vacuum interrupter 205 of FIG. 2 at a line A-A' in accordance with an exemplary embodiment of the present invention. FIG. 4 illustrates a cross-sectional view of the vacuum interrupter 205 of FIG. 2 at a line B-B' in accordance with an exemplary embodiment of the present invention.

Figure 5:
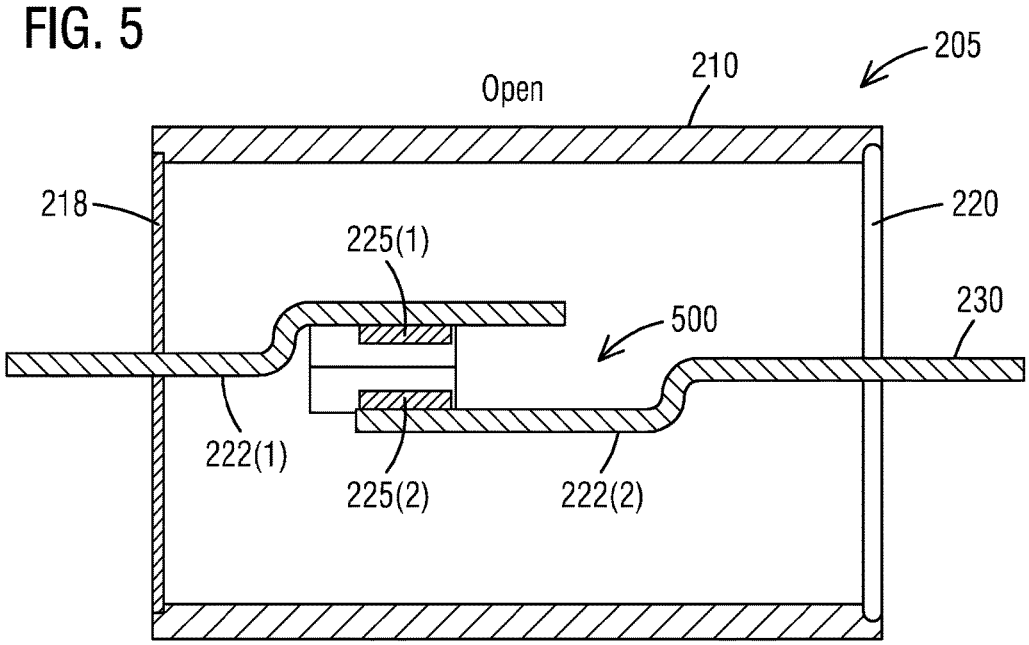
FIG. 5 illustrates a cross-sectional view of the vacuum interrupter of FIG. 3 to show an open operation of the vacuum interrupter in accordance with an exemplary embodiment of the present invention.
Figure 6:
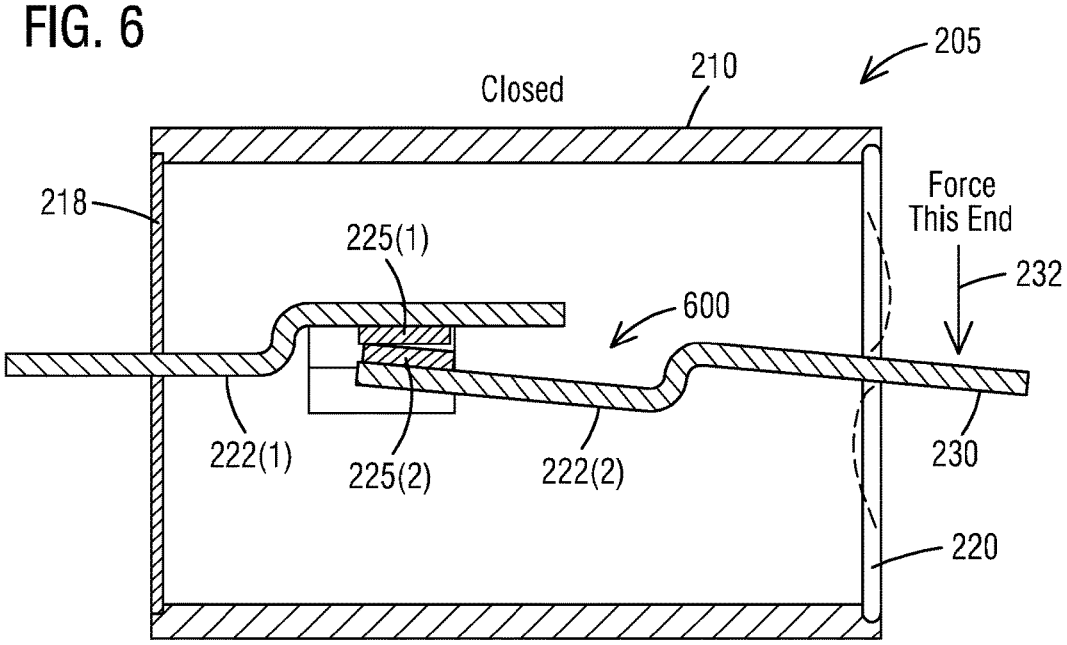
FIG. 6 illustrates a cross-sectional view of the vacuum interrupter of FIG. 3 to show a close operation of the vacuum interrupter in accordance with an exemplary embodiment of the present invention.

As seen in FIG. 5, it illustrates a cross-sectional view of the vacuum interrupter 5 of FIG. 3 to show an open operation 500 of the vacuum interrupter in accordance with an exemplary embodiment of the present invention. As shown in FIG. 6, it illustrates a cross-sectional view of the vacuum interrupter 5 of FIG. 3 to show a close operation 600 of the vacuum interrupter in accordance with an exemplary embodiment of the present invention.

In operation, a portion of the second contact terminal 222(2) may be moved outside of the glass sealed vacuum tube 210 by the force 232 such that the movable contact 225(2) may be opened or closed onto the fixed contact 225(1). The end spring 220 deforms and the motion of the movable arm is a pivoting motion instead of a linear motion by bellows. Instead of arc shields the first and second features 227(1-2) for protection from the arcs are provided. Embodiments of the present invention, however, are not limited to use in the described devices or methods.

Figure 7:
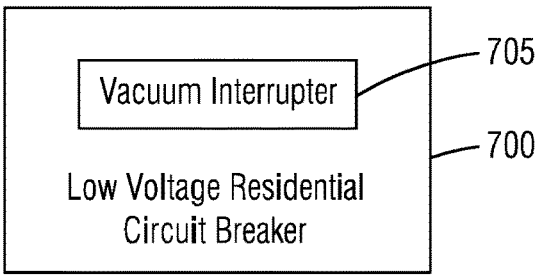
FIG. 7 illustrates a schematic of a block diagram of a low voltage residential circuit breaker including the vacuum interrupter of FIG. 1 in accordance with an exemplary embodiment of the present invention.

FIG. 7 illustrates a schematic of a block diagram of a low voltage residential circuit breaker 700 including a vacuum interrupter 705 in accordance with an exemplary embodiment of the present invention. The vacuum interrupter 705 is suitable for low voltage residential applications, being 240V or less and 60 A or less, having much less arcing to extinguish and having much lower dielectric requirements. The vacuum interrupter 705 comprises the sealed vacuum tube 210 and a structure in that by moving a portion of a movable arm outside the sealed vacuum tube 210, the movable contact 225(2) may be opened or closed onto the fixed contact 225(1). The vacuum interrupter 705 is an interruption device that is configured for low voltage residential applications (240V or less, 60 A or less). There is no open arc due to a sealed vacuum tube, i.e., the sealed vacuum tube 210 as it eliminates the arcing contamination to the rest of the breaker 700 and increases reliabilities. The vacuum interrupter 705 potentially increases the free space inside the residential circuit breaker 700. This vacuum interrupter 705 does not end up to be cost prohibitive in low voltage residential applications. Also components of this vacuum interrupter 705 can be easily made to meet the high production volume in the residential market.

While a vacuum interrupter operational with a pivoting motion is described here a range of one or more other types of vacuum interrupters are also contemplated by the present invention. For example, other types of vacuum interrupter may be implemented based on one or more features presented above without deviating from the spirit of the present invention.

The techniques described herein can be particularly useful for a vacuum interrupter for use in a low voltage residential circuit breaker. While particular embodiments are described in terms of the vacuum interrupter embedded within a low voltage residential circuit breaker, the techniques described herein are not limited to the a low voltage residential circuit breaker but can also be used with other systems such as power distribution systems where circuit breakers are deployed.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A low voltage residential circuit breaker comprising:

a vacuum interrupter including a sealed vacuum tube, wherein the sealed vacuum tube having a first end and a second end such that the sealed vacuum tube is being closed at the first end with an end plate and closed at the second end with an end spring, the vacuum interrupter further comprising:

a first contact terminal passing through the end plate and having a fixed contact near a distal end of the first contact terminal, wherein the first contact terminal having a first feature to protect from arcs by limiting access of the arcs to other components, and a second contact terminal having a free end, wherein the second contact terminal passing through the end spring and having a movable contact being configured to contact the fixed contact of the first contact terminal, wherein the second contact terminal having a second feature to protect from the arcs by limiting access of the arcs to the other components, wherein the end spring is configured to receive a force on the free end of the second contact terminal to provide open or close operations of the vacuum interrupter, wherein the first feature to protect from the arcs includes a first bend on the first contact terminal, first and second wings on the first contact terminal, and an extension on the first contact terminal, and wherein the second feature to protect from the arcs includes a second bend on the second contact terminal being a movable arm.

2. The low voltage residential circuit breaker of claim 1, wherein the fixed contact is mounted on the first contact terminal which is in turn mounted on the end plate and the sealed vacuum tube comprising at least one of a group of materials including a glass, a ceramic, and a glass-ceramic.

3. The low voltage residential circuit breaker of claim 2, wherein the fixed contact is welded on the first contact terminal.

4. The low voltage residential circuit breaker of claim 2, wherein the fixed contact is riveted on the first contact terminal.

5. The low voltage residential circuit breaker of claim 2, wherein the first contact terminal is brazed on the end plate and the end plate is sealed on the sealed vacuum tube.

6. The low voltage residential circuit breaker of claim 2, wherein the first contact terminal is soldered on the end plate and the end plate is sealed on the sealed vacuum tube.

7. The low voltage residential circuit breaker of claim 1, wherein the movable contact is mounted on the second contact terminal being a movable arm which is mounted on the end spring.

8. The low voltage residential circuit breaker of claim 7, wherein the movable contact is welded on the movable arm.

9. The low voltage residential circuit breaker of claim 7, wherein the movable contact is riveted on the movable arm.

10. The low voltage residential circuit breaker of claim 7, wherein the movable arm is brazed on the end spring and the end spring is sealed on the sealed vacuum tube.

11. The low voltage residential circuit breaker of claim 7, wherein the movable arm is soldered on the end spring and the end spring is sealed on the sealed vacuum tube.

12. The low voltage residential circuit breaker of claim 7, wherein by moving a portion of the movable arm outside the sealed vacuum tube, the movable contact is configured to be opened or closed onto the fixed contact.

13. The low voltage residential circuit breaker of claim 12, wherein the end spring deforms such that the motion of the movable arm is a pivoting motion.

14. The low voltage residential circuit breaker of claim 13, wherein the end spring having a material, a thickness and a diameter which are chosen in such a way that the end spring stays in an elastic range during the open or close operations.

15. A vacuum interrupter comprising:

a sealed vacuum tube comprising at least one of a group of materials including a glass, a ceramic, and a glass-ceramic, wherein the sealed vacuum tube having a first end and a second end such that the sealed vacuum tube is being closed at the first end with an end plate and closed at the second end with an end spring;

a first contact terminal passing through the end plate and having a fixed contact near a distal end of the first contact terminal; and a second contact terminal having a free end, wherein the second contact terminal passing through the end spring and having a movable contact being configured to contact the fixed contact of the first contact terminal, wherein the end spring is configured to receive a force on the free end of the second contact terminal to provide open or close operations of the vacuum interrupter, wherein the first contact terminal having a first feature to protect from arcs by limiting access of the arcs to other components, and wherein the first feature to protect from the arcs includes a first bend on the first contact terminal, first and second wings on the first contact terminal, and an extension on the first contact terminal.

16. The vacuum interrupter of claim 15, wherein the second contact terminal having a second feature to protect from the arcs by limiting access of the arcs to the other components.

17. The vacuum interrupter of claim 16, wherein the second feature to protect from the arcs includes a second bend on the second contact terminal being a movable arm.

* * * * *